United States Patent [19]

Jorendal et al.

[11] 4,277,770

[45] Jul. 7, 1981

[54] REGULATING WINDING STRUCTURE FOR TRANSFORMER

[75] Inventors: Gunnar Jorendal; Adrian von Renteln, both of Ludvika, Sweden

[73] Assignee: ASEA Aktiebolag, Vesteras, Sweden

[21] Appl. No.: 79,989

[22] Filed: Sep. 28, 1979

[30] Foreign Application Priority Data

Oct. 2, 1978 [SE] Sweden ..... 7810281

[51] Int. Cl.[3] ..... H01F 27/08; H01F 15/14

[52] U.S. Cl. ..... 336/60; 336/70; 336/186

[58] Field of Search ..... 336/60, 69, 70, 186, 336/187

[56] References Cited

U.S. PATENT DOCUMENTS

| | | | |
|---|---|---|---|
| 1,554,250 | 9/1925 | Woodrow | 336/60 |
| 2,862,195 | 11/1958 | Kury | 336/69 X |
| 3,151,304 | 9/1964 | Miller | 336/60 X |
| 3,183,460 | 5/1965 | Bennon | 336/60 X |

*Primary Examiner*—Thomas J. Kozma

*Attorney, Agent, or Firm*—Watson, Cole, Grindle & Watson

[57] ABSTRACT

A regulating winding for a high power transformer which includes a conductor bunch having a multiplicity of series-connected, parallel conductor loops, each loop comprising at least two parallel loop strands. The conductor bunch includes a number of radial and/or axial cooling channels, and the loop strands and the cooling channels are so arranged that the voltage difference between two loop strands located adjacent each other, and preferably positioned together between two cooling channels, is considerably higher than the voltage difference between loop strands positioned on either side of the cooling channels.

4 Claims, 5 Drawing Figures

REGULATING WINDING STRUCTURE FOR TRANSFORMER

BACKGROUND OF THE INVENTION

FIELD OF THE INVENTION

The present invention relates to regulating windings for transformers, and preferably to regulating windings for high power rating-type and high voltage-type transformers.

PRIOR KNOWLEDGE

The dimensioning with regard to transient voltages of regulating windings used in high power transformers is often a compromise between the required amount of strand insulation and the required overall cooling characteristics. In this regard, with increasing thickness of the solid insulating material surrounding the conductor strands in the loops of the regulating windings, the voltage strength between the loops will increase; however, the cooling characteristics will be less good. At the same time, the capacity of a winding to withstand and attenuate transient voltages is at least partially dependent on the capacity of the winding to store energy, i.e., due to its inherent capacitance, which in turn depends in part on the thickness of the insulation between the various conductor strands and the voltage difference therebetween. An increased thickness of insulation results in poorer capacitive properties.

An object of the present invention is to provide a regulating winding structure which will simultaneously allow for improved cooling characteristics as well as an increased capacity of the regulating windings to store energy (and thus improve attenuation of the oscillations upon the occurrence of transient voltages), the invention being specifically applicable to helical-type regulating windings which have one or more radial winding layers.

SUMMARY OF THE INVENTION

According to the present invention the conductor strands of the series-connected loops in the regulating winding are positioned with respect to the cooling channels, which may extend in radial and/or axial direction, such that the voltage difference between adjacent contacting loops is the maximally allowed difference with respect to the operating voltage of the loop strands, and such that the voltage difference between loops positioned across from each other with respect to a cooling channel is a minimum.

A further understanding of the invention will be achieved from a review of the attached drawing taken in conjunction with the following discussion.

DETAILED DESCRIPTION OF THE PREFERRED EMBODIMENT

Figure 2:
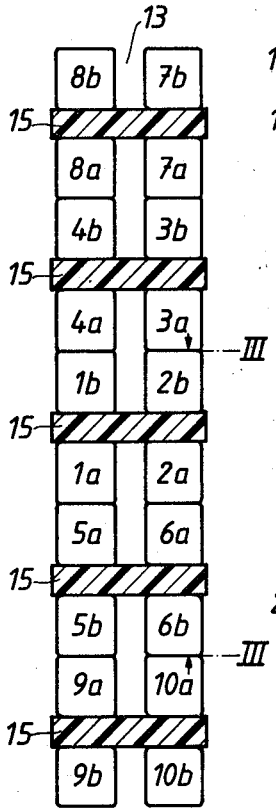
FIG. 2 schematically depicts a detailed cross-sectional view through a conductor bunch in accordance with the present invention.
Figure 1:
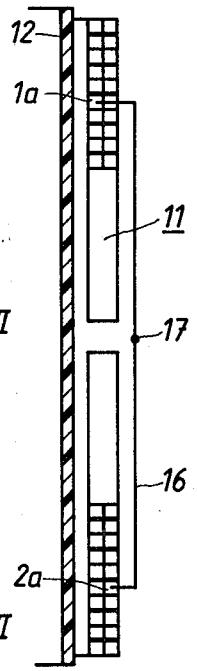
FIG. 1 schematically depicts a partial axial sectional view of an insulating cylinder having a regulating winding therearound which is constructed in accordance with the present invention.

As shown in FIG. 1, the regulating winding 11, which is constructed in accordance with the present invention, is located outside of an insulating cylinder 12 in a known fashion and is made of a predetermined number of winding turns. The inventive winding is in fact composed of a conductor bunch, and a detail of such a bunch in cross-section is shown in FIG. 2, this cross-section being shown at the top of FIG. 1. The conductor bunch is composed of ten conductors labeled 1, 2, 3 . . . 10, each comprising two parallel conductor loop strands 1*a*, 1*b*, 2*a*, 2*b*, 3*a*, 3*b*, . . . 10*a*, 10*b*. If the bunch is wound N turns, the entire winding will consist of ten loops arranged in parallel, each loop comprising N winding turns having two parallel conductor loop strands. The loops are connected in series such that, for example, the lower end of loop 1 will be connected to the upper end of loop 2 by a transition 16 on which is arranged a tap 17 for connection to a contact on a tap changer (this feature being well known and thus not shown). FIG. 2 shows that for each conductor the two parallel conductor loop strands a and b are arranged one above the other, i.e., when viewed along the axial direction of the winding. In a radial direction, i.e., with respect to insulating cylinder 12, are two conductor loop strands which belong to two adjacent loops for example, as shown by the positionings of strands 1*a*, 2*a*, 1*b*, 2*b*, 4*a*, 3*a*, etc. Between these loop strands prevails a voltage which corresponds to one tenth that of the entire winding voltage, i.e., in the event that, as herein assumed, the winding comprises ten loops.

Figure 3:
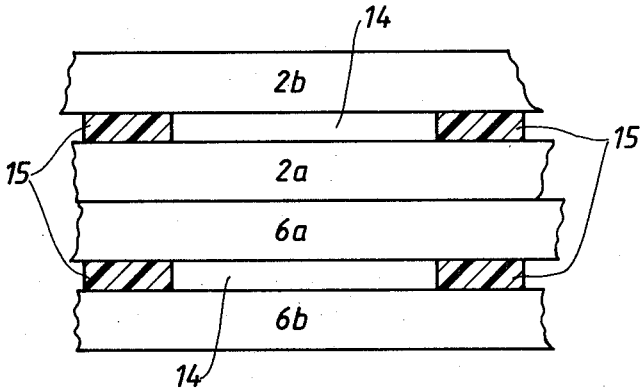
FIG. 3 schematically depicts a sectional view taken along line III—III of FIG. 2.

In order to achieve an efficient cooling of the winding, axially oriented and radially oriented cooling channels 13 and 14 (see FIG. 3) are arranged within the conductor bunch of the FIG. 2 embodiment. The axially extending channel 13 (formed by spacer bars, not shown) is annular in its relationship to the insulating cylinder 12 and is located between the winding layer which includes loops 1, 4, 5, 8 and 9, and the winding layer which includes loops 2, 3, 6, 7 and 10. The radially extending channels 14, as best seen in FIG. 3, are formed by inserting spacers 15 between every other conductor loop strand in the axial direction of the winding (note cooling channels 14 formed between conductor loop strands 2*b* and 2*a*, and between 6*a* and 6*b*). As can be seen from FIG. 2, the spacers 15 divide the axially extending channel 13, which is located between the two winding layers, into a number of axially extending partial channels (which are connected to each other in a tangential direction between the spacers 15).

It is obvious that in the FIG. 2–3 embodiment of the invention the conductor loop strands located on either side of spacer 15 will have the same voltage. On the other hand, as between adjacent conductor loop strands located between two spacers, a relatively high voltage will prevail, and except in one case, will be generally four times the loop voltage. In other words, according to the FIG. 2 embodiment of the invention, the two parallel loop strands a and b or each conductor loop are positioned in the same winding layer such that there will be a zero voltage between the conductor loop strands which adjoin a radial cooling channel 14; however, between the conductor loop strands which adjoin the axial cooling channel, there will be a voltage which corresponds to the voltage across a loop of the winding.

Figure 4:
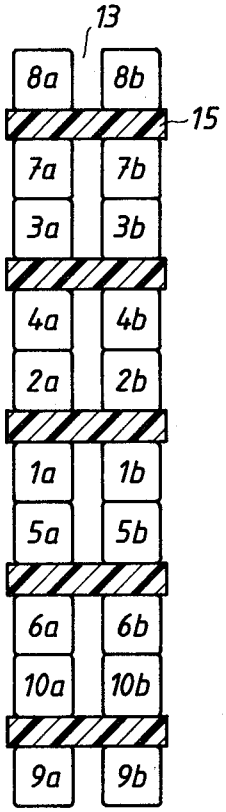
FIG. 4 schematically depicts a conductor bunch which is constructed in an alternative fashion to that shown in FIG. 2.

An alternative embodiment of the invention is shown in FIG. 4. In this embodiment the two parallel loop strands a and b of each conductor loop are located radially with respect to one another, each in effect in a different winding layer. Thus, no voltage will prevail in the radial direction across the axial cooling channel 13; however, across the cooling channel 14 will be a one loop voltage. Between two loop strands, for example 1*a* and 5*a*, which are located adjacent each other and between two radial cooling channels, a voltage will prevail (with one exception) which is four times the loop voltage.

Figure 5:
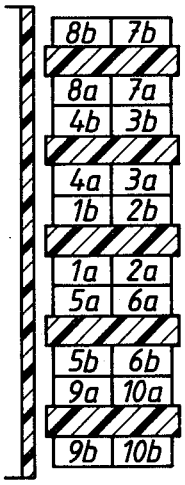
FIG. 5 schematically depicts a conductor bunch construction similar to that shown in FIG. 2 but wherein the conductor strands have a rectangular cross-section.

The conductor loop strands shown in FIGS. 1, 2 and 4 are shown to have substantially square cross-sectional areas; however, loop strands having rectangular cross-sections are normally used. Since the capacity of the winding to take and store energy depends on its capacitive coupling between adjacent winding turns, it is advantageous, when using loop strands having a rectangular cross-section, to place the longer sides of adjacent loop strands against one another, i.e., with a radial orientation as shown in FIG. 5. Alternatively, the conductor loop strands may be turned 90° so that the longer side of the rectangular cross-section will be oriented in an axial direction. The amount of available space in each of these directions will determine which alternative construction should be used. Also, the arrangement of the cooling channels in the axial and/or radial directions will be influenced by the available space. In this regard, FIG. 5 shows only the radial cooling channels which are determined by spacers 15; alternatively, it is possible to use only axial cooling channels, or to use both axial and radial cooling channels.

While there has been shown and described some of the various preferred embodiments of the present invention, it will be obvious that various changes and modifications can be made therein without departing from the invention as defined in the appended claims.

We claim:

1. A regulating winding for a transformer, comprising:

a substantially cylindrical winding body with two end portions;

a plurality of substantially helical conductors, each helical conductor extending between said end portions and including a plurality of turns and composed of at least two substantially helical conductor strands parallelly connected with each other;

said helical conductors being serially interconnected by means of transitions;

the conductor strands of each said helical conductor are mutually oppositely disposed such that a plurality of surfaces of said helical conductor strands form at least a portion of a plurality of cooling channels;

a plurality of interspaces being formed between said cooling channels, each including a pair of mutually adjacent helical conductor strands; and the voltage between mutually opposed points of said mutually adjacent helical conductor strands is higher than twice the voltage across any of said helical conductors.

2. The regulating winding of claim 1, wherein some of the surfaces defining said cooling channels are surfaces belonging to a plurality of radially oriented spacers disposed between axially adjacent helical conductor strands.

3. The regulating winding of claim 2, wherein two helical conductor strands belonging to one and the same helical conductor are arranged in direct mechanical contact with a spacer and disposed at different spacer sides.

4. The regulating winding of claim 2, wherein said helical conductor strands comprise a plurality of radially inner helical conductor strands and a plurality of radial outer helical conductor strands with a plurality of helical gaps defined between said radial inner strands and said radial outer strands, said helical conductors each comprising said radial inner helical conductor strand and an adjacent one of said radial outer helical conductor strands.

* * * * *